US008756949B2

(12) United States Patent
Nyheim et al.

(10) Patent No.: US 8,756,949 B2
(45) Date of Patent: Jun. 24, 2014

(54) COOLING DEVICE

(75) Inventors: Kurt Steinar Nyheim, Skatval (NO); Jan Ragnar Stokke, Stjordal (NO)

(73) Assignee: Envent AS, Hommelvik (NO)

( * ) Notice: Subject to any disclaimer, the term of this patent is extended or adjusted under 35 U.S.C. 154(b) by 0 days.

(21) Appl. No.: 10/510,719

(22) PCT Filed: Apr. 14, 2003

(86) PCT No.: PCT/NO03/00119

§ 371 (c)(1),
(2), (4) Date: May 16, 2005

(87) PCT Pub. No.: WO03/090588

PCT Pub. Date: Nov. 6, 2003

(65) Prior Publication Data

US 2006/0042287 A1 Mar. 2, 2006

(30) Foreign Application Priority Data

Apr. 25, 2002 (NO) ..... 20021945

(51) Int. Cl.
*F25D 23/10* (2006.01)

(52) U.S. Cl.
USPC ..... 62/263; 62/515; 62/246

(58) Field of Classification Search
USPC ..... 62/246–256, DIG. 1, 515–524, DIG. 16, 62/237, 448; 165/53–57, 144
See application file for complete search history.

(56) References Cited

U.S. PATENT DOCUMENTS

| | | | | | |
|---|---|---|---|---|---|
| 2,683,355 | A | * | 7/1954 | Schmidt | 62/252 |
| 2,956,420 | A | * | 10/1960 | Replogle | 62/256 |
| 4,537,040 | A | * | 8/1985 | Ibrahim | 62/186 |
| 4,574,868 | A | * | 3/1986 | Anders | 165/144 |
| 4,586,346 | A | * | 5/1986 | St-Pierre | 62/259.1 |
| 4,628,697 | A | * | 12/1986 | Bruck et al. | 62/89 |
| 4,679,617 | A | * | 7/1987 | Keldmann | 165/56 |
| 4,777,806 | A | | 10/1988 | Perez | |
| 5,042,570 | A | * | 8/1991 | Schmitt-Raiser et al. | 165/56 |
| 5,172,567 | A | * | 12/1992 | Sadhir | 62/434 |
| 5,363,908 | A | * | 11/1994 | Koster | 165/49 |
| 5,477,702 | A | * | 12/1995 | Kennedy et al. | 62/256 |
| 5,690,165 | A | * | 11/1997 | Roth et al. | 165/54 |
| 6,141,979 | A | * | 11/2000 | Dunlap | 62/176.6 |
| 6,164,466 | A | * | 12/2000 | Baradat | 211/186 |
| 6,564,858 | B1 | * | 5/2003 | Stahl et al. | 165/97 |

FOREIGN PATENT DOCUMENTS

| | | | |
|---|---|---|---|
| DE | 3841357 | | 6/1990 |
| EP | 527339 | | 2/1993 |
| EP | 702918 | | 3/1996 |
| FR | 2 637 965 | * | 4/1990 |
| JP | 02298736 A | * | 12/1990 |

* cited by examiner

*Primary Examiner* — Cassey D Bauer
(74) *Attorney, Agent, or Firm* — Ladas & Parry LLP

(57) ABSTRACT

Cooling device with a cooling unit connected to a cooling means for providing cooled air to the surroundings and which is located over an area for arranging merchandise to be refrigerated. The device includes a frame structure to be suspended freely over a merchandising area, with the cooling unit being arranged in the frame structure together with the further parts of a refrigerating unit.

9 Claims, 3 Drawing Sheets

COOLING DEVICE

This application is a filing under 35 USC 371 of PCT/NO03/00119 filed Apr. 14, 2003.

The invention relates to a cooling device arranged over an area for arranging merchandise to be refrigerated.

BACKGROUND OF THE INVENTION

In vending premises various merchandise has to be exposed and refrigerated. This is normally done by placing the goods in partly closed cabinets having a superstructure with refrigerating equipment or at least with a cooling element, the remaining parts being accommodated in the lower parts of the cabinet. This solution is expensive both in building and running, because the cabinet structure is extensive and the merchandise has to be manually introduced. A cabinet will also be tied up in its arrangement, normally relatively to a wall.

From Danish patent publication 129188 (Nygren 1974) it is known to design a cooling unit for flowers with a superstructure containing cooling elements. To introduce the goods, manual handling is needed. Additionally an equipment with a superstructure will correspond to a cabinet in regard of costs.

From U.S. Pat. No. 4,777,806 (Stanley Knight 1988), another counter is known, which is designed for exposing various kinds of refrigerated goods, with access from all sides. To improve the economic aspect of the refrigeration, this counter is provided with recirculation, run by a fan, which recirculation leads downwards flowing, cool air into the die base, after flowing over the goods that are to be kept cool, and from there, up through a rising channel to the upper edge of the cooling element. This improves the efficiency of the refrigeration, but requires more extensive equipment and a counter-solution, which in every case must be manually filled with goods.

From EP patent application 702918 (Electrolux 1995) it is known a refrigerated counter, which has a traditional box-solution, where a cooling element which is connected to the refrigerating machine in the die base of the counter, is positioned above the refrigerated counter. The purpose of this integrated solution is to achieve a more even, low temperature in the refrigerated goods. This arrangement is not suitable for creating a flexible, inexpensive and efficient refrigerating solution, for instance for volume merchandise such as fruits and vegetables and soft drinks

SUMMARY OF THE INVENTION

The main object of the invention is to create a cooling device, which satisfies the demands regarding low price, efficient handling of goods, flexible positioning, and which has the possibility of refrigerating a part of an area.

It should be possible to position it freely in a room, without connection to walls or fixed structures. Hence, it should be possible to use it selectively, so that refrigerated goods can be placed together with accompanying goods that do not need refrigeration, so that these do not occupy valuable refrigerated space.

It is of special interest to create a cooling device that can be used together with an arbitrary exposure of goods, for instance in transport containers or a pallet arrangements with merchandise containers, which enter the sale premises from the outside.

With the cooling device of the invention, costs can be considerably reduced. When used with an arbitrary vending counter, with some adjustment of the goods area, an acceptable operating economy is achievable.

BRIEF DESCRIPTION OF THE DRAWINGS

The invention is illustrated in the drawings, in which.

DESCRIPTION OF THE PREFERRED EMBODIMENTS

Figure 1:
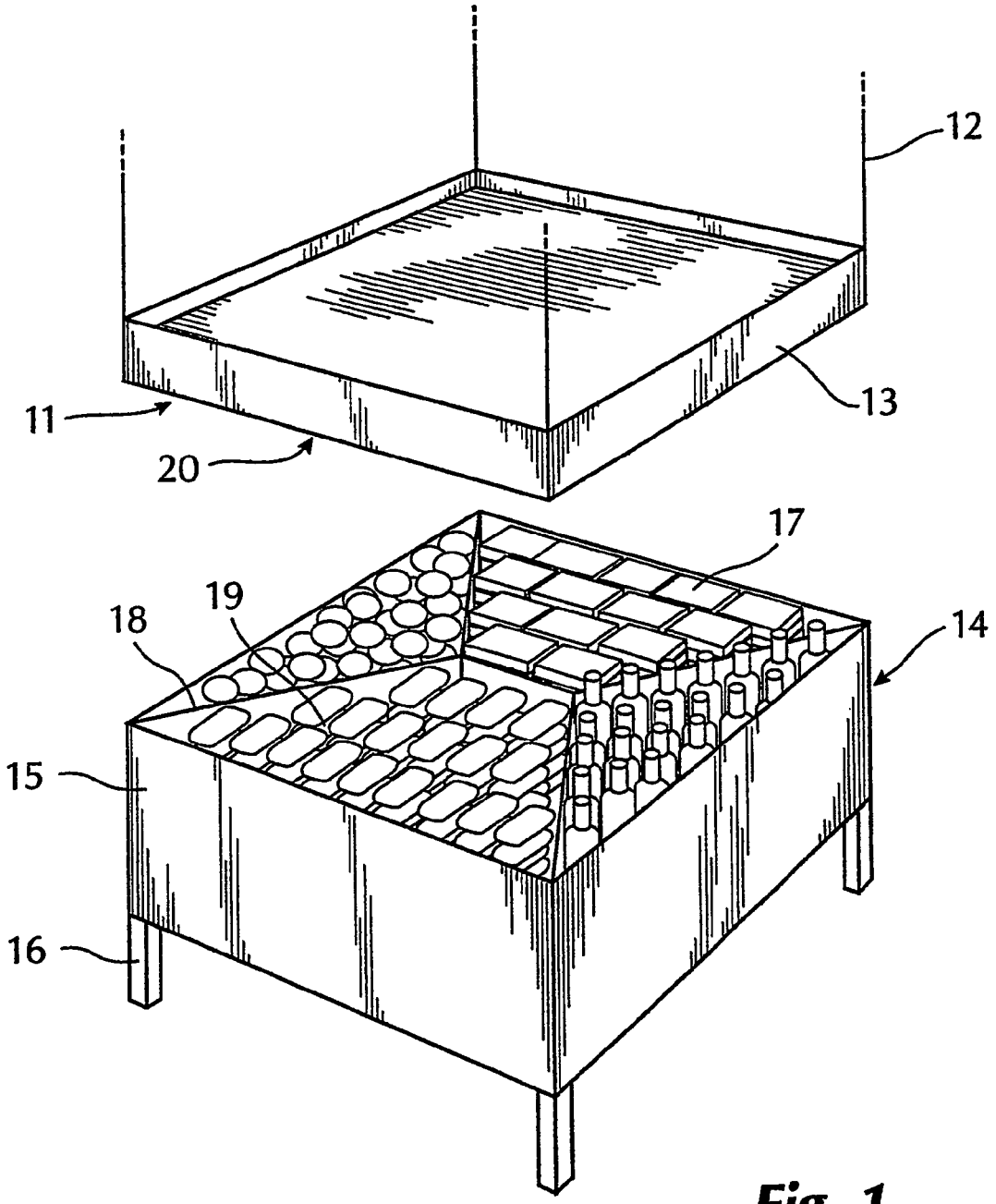
FIG. 1 is a schematic perspective view of a cooling device according to the invention, in its basic form, positioned above a vending table for fruits and vegetables.

In FIG. 1 is shown a cooling device 11 according to the invention, which is suspended on four suspension wires 12, which may be attached underneath the ceiling or in carrying structures in vending premises. The cooling device 11, which has a rectangular frame 13, formed as box-sides, will be descried further in the following.

Below the cooling device 11, there is arranged a vending table or counter 14 with a box-shaped upper part 15 and four legs 16. In the box-shaped upper part 15 there are placed goods 17, which shall be refrigerated. In the example with partition walls 18, the box-shaped upper part 15 is divided into cages 19 for different types of goods. More details of the vending table will be described below.

Figure 2:
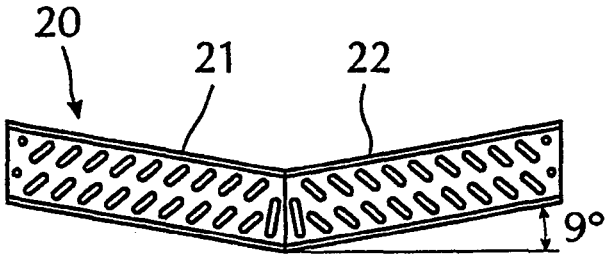
FIG. 2 is an end elevation view of a cooling element for use with the cooling device in FIG. 1.
Figure 3:
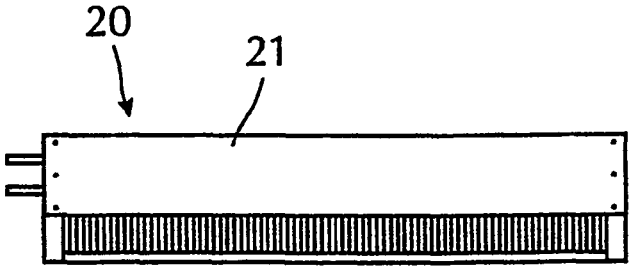
FIG. 3 is a side elevation view of the cooling element in FIG. 2.
Figure 4:
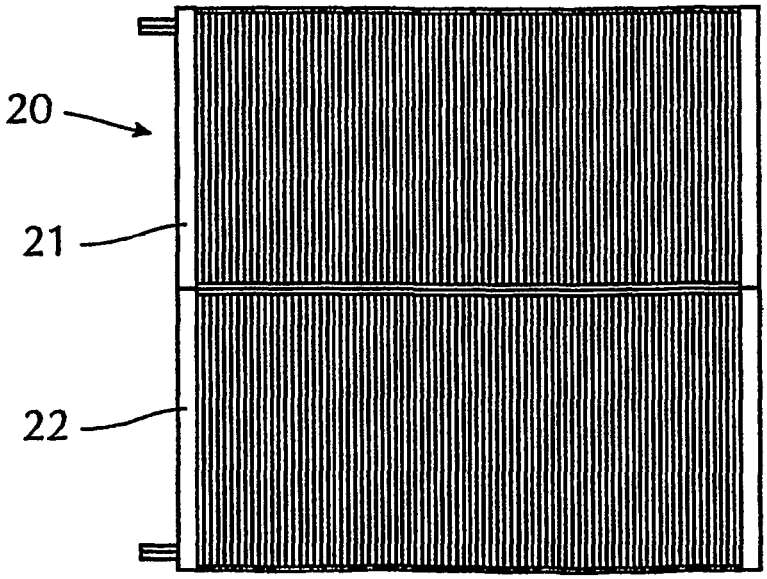
FIG. 4 is a bottom plan view of the cooling element in FIG. 2.

In FIGS. 2, 3 and 4 are shown an end elevation, side elevation and a bottom plan view of a cooling element or an evaporator 20, intended for use in the cooling device 11 in FIG. 1. The cooling element 20 comprises two blocks 21, 22, which are arranged against one another, and integrated to one unit with a common side, so that they form an upwards facing angle of approximately 160°. The purpose of this oblique position is to increase the efficiency of the cold production.

In addition, the cooling device 11 will be equipped with compressor, condenser and other known elements in a cooling unit. These can be designed in a known manner, as long as they are adjusted for a suspended positioning as illustrated in FIG. 1.

Figure 5:
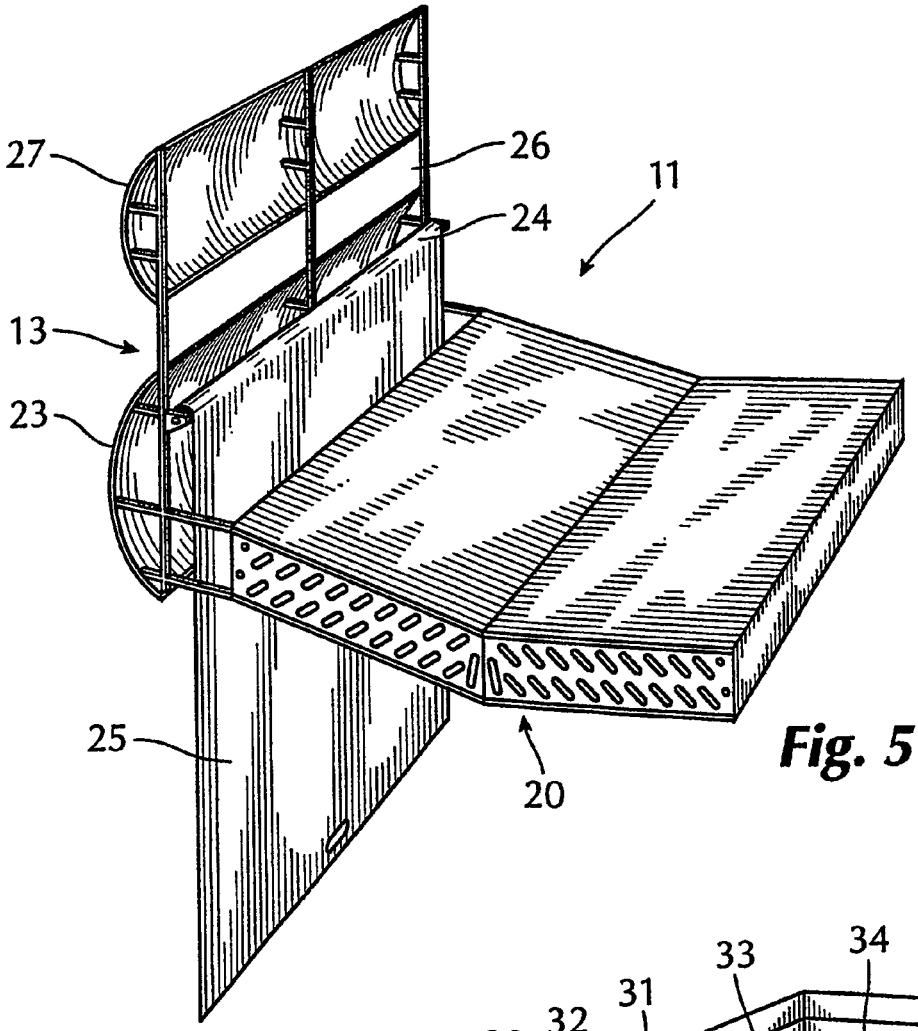
FIG. 5 is a sectional perspective view of an embodiment with a curtain for night shielding.

In FIG. 5 is shown a sectional perspective view of an alternative embodiment of the cooling device 11. Each side of the cooling device comprises a shield 23 with a profile that curves outwards. Inside this shield, there is installed a roller blind bar 24 with a roller blind 25, which can be pulled down.

Above this part and with a narrow space 26, a corresponding frame part 27 is arranged. This shields parts of the cooling system and can function as an area for advertisement.

Figure 6:
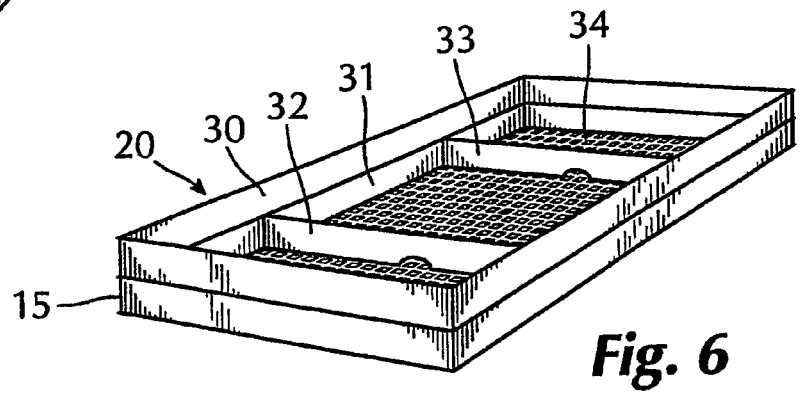
FIG. 6 is a perspective view of a box that can be used for keeping goods that shall be refrigerated, as well as a cold-trap.
Figure 7:
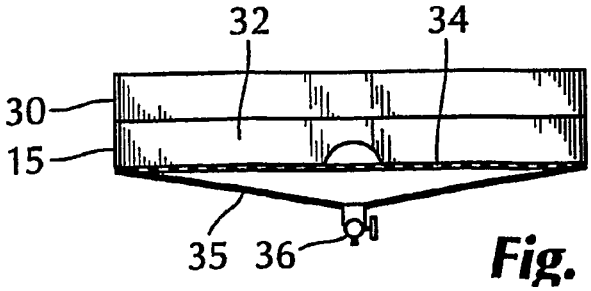
FIG. 7 is a vertical cross-section view of the box in FIG. 6.

In FIGS. 6 and 7 there are shown details of an embodiment of the vending table 14. In this example, the box-shaped upper part 15 has a frame 30, which rises above an area 31, for placing of goods, and which forms a cold-trap. The area 31 for placing of goods is divided into three zones with parallel partition walls 32, 33. The vending table 14 has a substantially plane and perforated or grid-shaped bottom 34 underneath the area 31 for placing of goods, and a lower, funnel-shaped sub-bottom 35 for collection of any condensed water.

For draining off condensed water, a drain valve 36 is arranged at the lower apex of the sub-bottom 35.

As an alternative to the vending table 14 described above, the goods can be placed in boxes or in another manner on the top of a pallet underbody that can be driven in from a warehouse room. A loose frame that is shaped as the sides of a box, can be positioned on the top of such an underbody as a cold-trap.

Because the cooling device 11 can be moved easily, one achieves a total freedom regarding the positioning of the merchandise in vending premises. Besides, the handling of the merchandise is reduced to a minimum, something that reduces the vending costs.

It is estimated that the temperature will rise from 6° at the lower edge of the cooling element 20, to 8° at the upper side of the goods. At the same time, the shaping of the vending table with a frame-shaped wall that functions as a cold-trap, ensures that the cooled air is decelerated in a warm-up process over the goods. This forms the basis for a cooling effect that is surprisingly efficient.

By pulling down one or more of the shades 25, it is possible to further reduce the heat transfer from the surroundings. With the shades 25 pulled down on all sides, an efficient night shielding is achieved.

Hence, the invention makes it possible to achieve a satisfactorily efficient cooling device with inexpensive elements. The positioning is flexible, the arrangement is easy to alter, and the handling of goods is easy and effective.

The invention can be carried out with an external cooling unit as well, for instance an external unit that can run several cooling elements.

It is also possible to form a barrier against the surroundings with a tubular manifold, which is positioned around the frame, with downwards facing nozzles and which is supplied with pressurized air, possibly cooled air, which forms an air curtain with steadily flowing air.

The invention claimed is:

1. In combination, a support constructed and arranged for holding objects to be cooled on an upper surface thereof, a cooling device for providing cooled air to objects on the upper surface of the support, said cooling device comprising a frame which is selectively positioned and suspended over the support, the frame comprising a refrigerating unit having an evaporator comprising substantially vertical fins for cooling air, the frame being free of attachment to the support, wherein air cooled by the evaporator falls downwardly onto the support to cool objects thereon;

wherein the support comprises a sales base which is arranged independent of the frame; and wherein the sales base is provided with a box for accommodating objects which has an upper bottom and a lower bottom, the lower bottom being sloped downwardly and provided with a drain valve.

2. A cooling device for providing cooled air to an object, said cooling device comprising:

a frame;

a refrigerating unit disposed on the frame;

said refrigerating unit comprising an evaporator comprising vertical fins;

wherein the frame is freely positioned and suspended over the object;

wherein air cooled by the evaporator falls onto the object, and thereby cools the object; and wherein at least one side of the frame is provided with a downwardly extending blind.

3. A cooling device according to claim 2, wherein the evaporator is board-shaped with an exposed lower side.

4. A cooling device according to claim 2, wherein the evaporator comprises two blocks arranged against one another, and integrated into one unit with a common side, so that they form an upwardly facing angle of approximately 160°.

5. A cooling device according to claim 2, wherein the evaporator substantially covers the frame.

6. A cooling device according to claim 2, wherein the object is arranged in or on a support.

7. A cooling device according to claim 6, wherein a plurality of objects are arranged in or on the support.

8. A cooling device according to claim 2, wherein the cooling device is moveable.

9. A cooling device according to claim 6, wherein the frame is free of attachment to the support.

* * * * *